US010098390B2

(12) United States Patent
Ozbek

(10) Patent No.: US 10,098,390 B2
(45) Date of Patent: Oct. 16, 2018

(54) BATHROBE INCLUDING TOWEL

(71) Applicant: Mehmet Murat Ozbek, Vancouver (CA)

(72) Inventor: Mehmet Murat Ozbek, Vancouver (CA)

( * ) Notice: Subject to any disclaimer, the term of this patent is extended or adjusted under 35 U.S.C. 154(b) by 0 days.

(21) Appl. No.: 14/980,240

(22) Filed: Dec. 28, 2015

(65) Prior Publication Data

US 2017/0181484 A1 Jun. 29, 2017

(30) Foreign Application Priority Data

Dec. 24, 2015 (CA) ..... 2916294

(51) Int. Cl.

| | |
|---|---|
| ***A41D 13/00*** | (2006.01) |
| ***A41D 7/00*** | (2006.01) |
| ***A47K 10/02*** | (2006.01) |

(52) U.S. Cl.

CPC ..... *A41D 7/008* (2013.01); *A47K 10/02* (2013.01); *A41D 2200/20* (2013.01)

(58) Field of Classification Search

CPC .... A41D 7/008; A41D 2200/20; A41D 15/00; A41D 23/00; A47K 10/025; A42B 1/041

USPC ..... 2/69

See application file for complete search history.

(56) References Cited

U.S. PATENT DOCUMENTS 1,243,206 A 10/1914 Norman
1,497,685 A 6/1924 Hoyme
1,594,541 A * 8/1926 Mandell ..... A41D 27/18 2/85
2,198,577 A * 4/1940 Graham, Jr. ..... A41D 1/02 2/96
2,482,295 A * 9/1949 Schlafman ..... A41B 9/00 2/91
2,621,331 A * 12/1952 Loretto ..... A41D 7/008 2/75
2,706,817 A 4/1955 Schneider
2,851,690 A * 9/1958 Jennings ..... A45D 44/08 2/50
3,031,677 A * 5/1962 Murphy ..... A41D 1/02 2/91

(Continued)

FOREIGN PATENT DOCUMENTS

CN 2762733 3/2006
CN 201039755 3/2008

(Continued)

OTHER PUBLICATIONS

Thielgen, Extended European Search Report for EP16193840, dated Apr. 19, 2017.

*Primary Examiner* — Timothy K Trieu

(57) ABSTRACT

An apparatus includes a bathrobe having a vertically-extending placket extending along a front section of the bathrobe, and the vertically-extending placket is configured to allow the bathrobe to be put on or removed by a user. An elongated towel assembly is fixedly coupled to the bathrobe. The elongated towel assembly vertically hangs from and extends along any one of (A) a left-side vertically extending portion, (B) a right-side vertically extending portion, and (C) the left-side vertically extending portion and the right-side vertically extending portion of the bathrobe in such a way that the vertically-extending placket is available for usage by the user.

20 Claims, 4 Drawing Sheets

(56) References Cited

U.S. PATENT DOCUMENTS

| | | | | |
|---|---|---|---|---|
| 4,686,714 | A * | 8/1987 | Harley | A41D 15/005 2/105 |
| 5,697,102 | A | 12/1997 | Benjamin | |
| 5,855,021 | A | 1/1999 | Somerville | |
| 6,175,964 | B1 * | 1/2001 | Adler | A41D 15/00 2/207 |
| 8,175,964 | B2 * | 5/2012 | Arfin | G06Q 30/0601 705/1.1 |
| 2007/0028366 | A1 * | 2/2007 | Weis | A41D 1/00 2/244 |
| 2007/0283481 | A1 * | 12/2007 | Rawlings | A41D 7/008 2/114 |
| 2008/0127395 | A1 * | 6/2008 | Blauer | A41D 13/01 2/87 |
| 2009/0025119 | A1 | 1/2009 | Nespor | |
| 2009/0055989 | A1 | 3/2009 | Chih | |
| 2010/0031415 | A1 * | 2/2010 | Shadid | A41D 13/0012 2/87 |
| 2011/0179543 | A1 * | 7/2011 | Yoo | A41B 13/10 2/49.2 |

FOREIGN PATENT DOCUMENTS

| | | |
|---|---|---|
| CN | 202335359 | 7/2012 |
| DE | 3518488 | 11/1986 |
| EP | 0016028 | 4/1983 |
| GB | 718718 | 11/1954 |
| JP | 2000237089 | 9/2000 |
| WO | 9701293 | 1/1997 |
| WO | 0110255 | 2/2001 |

* cited by examiner

BATHROBE INCLUDING TOWEL

TECHNICAL FIELD

This document relates to the technical field of (and is not limited to) an apparatus including a bathrobe and an elongated towel assembly fixedly coupled to the bathrobe.

BACKGROUND

A towel is a piece of absorbent fabric used for drying or wiping the body or a surface. It draws moisture through direct contact, often using a blotting or a rubbing motion. A bathrobe is made from towelling or other absorbent textile, and may be donned while the wearer's body is wet, serving both as a towel and an informal garment.

SUMMARY

It will be appreciated that there exists a need to mitigate (at least in part) at least one problem associated with the existing bathrobes (also called the existing technology). After much study of the known systems and methods with experimentation, an understanding of the problem and its solution has been identified and is articulated as follows:

Hotel towels are generally washed excessively and even further disinfected, with special chemicals and sophisticated equipment. However, some hotel guests may still wonder and feel a little uncomfortable to use these towels for their faces and hair, because the towels may have been used in inappropriate ways by previous guests and/or by housekeeping staff (such as rubbing the towels on genital areas, etc.).

What is needed is an apparatus that substantially prevents the usage of a towel in such a way that the user of the towel feels comfortable about using the towel because the towel is not likely to be used in inappropriate ways by previous guests and/or by housekeeping, etc.

To mitigate, at least in part, at least one problem associated with the existing technology, there is provided (in accordance with a major aspect) an apparatus. The apparatus includes a bathrobe having a vertically-extending placket extending along a front section (front portion) of the bathrobe, and the vertically-extending placket is configured to allow the bathrobe to be put on or removed by a user. An elongated towel assembly is fixedly coupled to the bathrobe. The elongated towel assembly vertically hangs from and extends along any one of (A) a left-side vertically extending front portion, (B) a right-side vertically extending front portion, and (C) the left-side vertically extending front portion and the right-side vertically extending front portion of the bathrobe in such a way that the vertically-extending placket is available to the user.

In this arrangement, the elongated towel assembly is affixed to the bathrobe and, therefore, it is less likely that the elongated towel assembly would have been used in inappropriate ways by previous guests and/or by housekeeping (such as rubbing the towels on genital areas, etc.).

To mitigate, at least in part, at least one problem associated with the existing technology, there is provided (in accordance with a major aspect) an apparatus. The apparatus includes a bathrobe. The bathrobe includes a yoke section surrounding, at least in part, a neck opening configured to receive the neck of a user. A front left chest area extends below the yoke section. The front left chest area is configured to be positioned on the front left chest of the user once the user wears the bathrobe. A front right chest area extends below the yoke section. The front right chest area is spaced apart from the front left chest area. The front right chest area is configured to be positioned on the front right chest of the user once the user wears the bathrobe. A vertically-extending placket extends below the yoke section. The vertically-extending placket physically separates the front left chest area and the front right chest area. In addition, the vertically-extending placket physically separates the right skirt area and the left skirt area located or positioned below the belt). The vertically-extending placket has a left portion bordering the front left chest area and also has a right portion bordering the front right chest area. In addition, the left portion borders the front left skirt area, and the right portion borders the front right skirt area. An elongated towel assembly is fixedly coupled to the bathrobe. The elongated towel assembly is vertically aligned along a vertical length of the vertically-extending placket. More preferably, the elongated towel assembly is vertically aligned along a vertical length of the vertically-extending placket. The elongated towel assembly does not extend (in length) and reach any one of (A) the front left skirt area, (B) the front right skirt area, and (C) the front left skirt area and the front right skirt area. Generally, the elongated towel assembly vertically hangs along any one of (A) the left portion, (B) the right portion, and (C) the left portion and the right portion of the vertically-extending placket (on opposite sides thereof). In accordance with a preferred embodiment, there is a first instance of the elongated towel assembly that vertically hangs along the left portion of the vertically-extending placket, and there is a second instance of the elongated towel assembly that vertically hangs along the right portion of the vertically-extending placket. The elongated towel assembly extends, at least in part, along any one of (A) the front left chest area, (B) the front right chest area, and (C) the front left chest area and the front right chest area. Once the bathrobe is worn by the user, the user may grasp and use the elongated towel assembly (such as, for drying the hair, the head, the neck and/or the face of the user).

Other aspects are identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
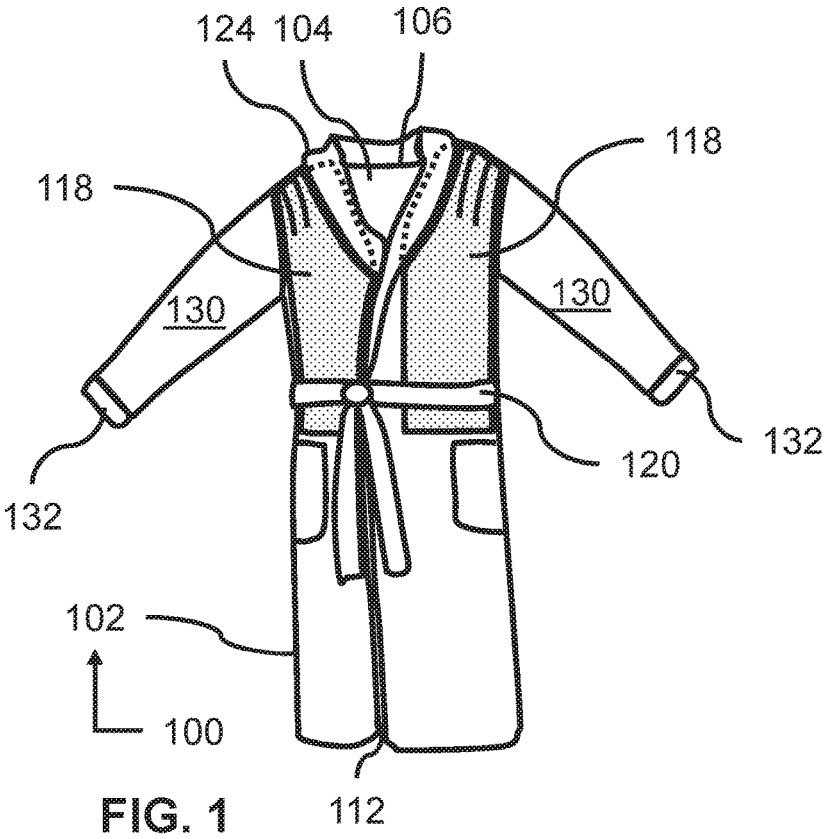
FIG. 1 and FIG. 2 depict a front view and a rear view (respectively) of an embodiment of an apparatus including a bathrobe.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 bathrobe
104 yoke section
106 neck opening
108 front left chest area
110 front right chest area
112 vertically-extending placket
114 left portion
116 right portion
118 elongated towel assembly
120 belt
122 loops
124 collar
126 neckline
128 armholes
130 arm
132 cuff
134 stitches
136 front left skirt area
138 front right skirt area
900 user

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

Figure 2:
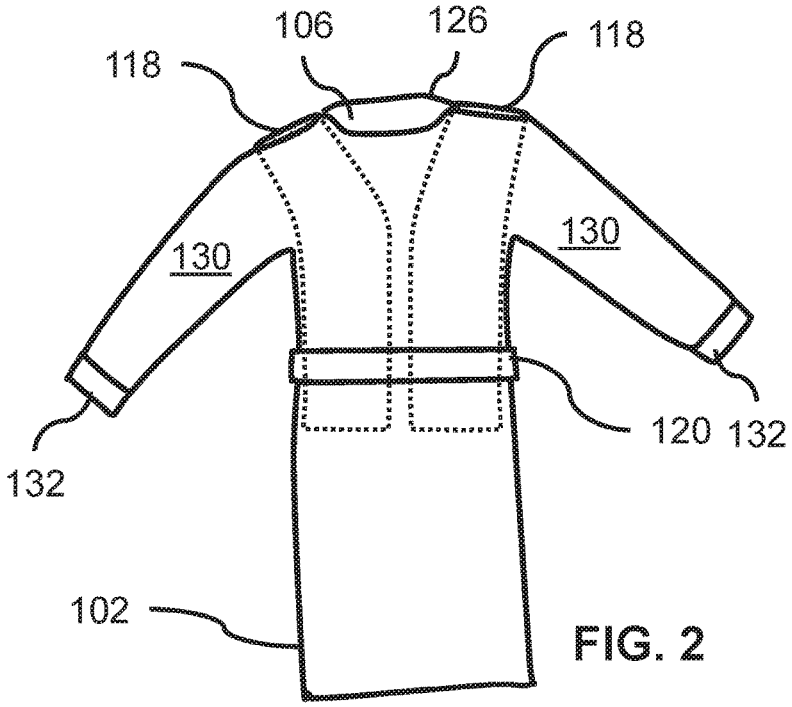

FIG. 1 and FIG. 2 depict a front view and a rear view (respectively) of an embodiment of an apparatus 100 including a bathrobe 102.

In accordance with a first general embodiment as depicted in FIG. 1 and FIG. 2 (and in accordance with the embodiments depicted in all of the FIGS.), the apparatus 100 includes (and is not limited to) a bathrobe 102 having a vertically-extending placket 112 extending along a front section of the bathrobe 102. The vertically-extending placket 112 is configured to allow the bathrobe 102 to be put on or removed by a user. The bathrobe 102 also includes an elongated towel assembly 118 fixedly coupled to the bathrobe 102. The elongated towel assembly 118 vertically hangs from and extends along any one of (A) a left-side vertically extending front portion, (B) a right-side vertically extending front portion, and (C) the left-side vertically extending front portion and a right-side vertically extending front portion of the bathrobe 102 in such a way that the vertically-extending placket 112 is available to the user.

In accordance with a second general embodiment as depicted in FIG. 1 and FIG. 2 (and in accordance with the embodiments depicted in all of the FIGS.), the apparatus 100 includes (and is not limited to) the bathrobe 102, in which the bathrobe 102 includes a synergistic combination of a yoke section 104 (also depicted in FIG. 5), a front left chest area 108 (also depicted in FIG. 3 and FIG. 5), a front right chest area 110 (also depicted in FIG. 3 and FIG. 5), a vertically-extending placket 112, and an elongated towel assembly 118.

Figure 3:
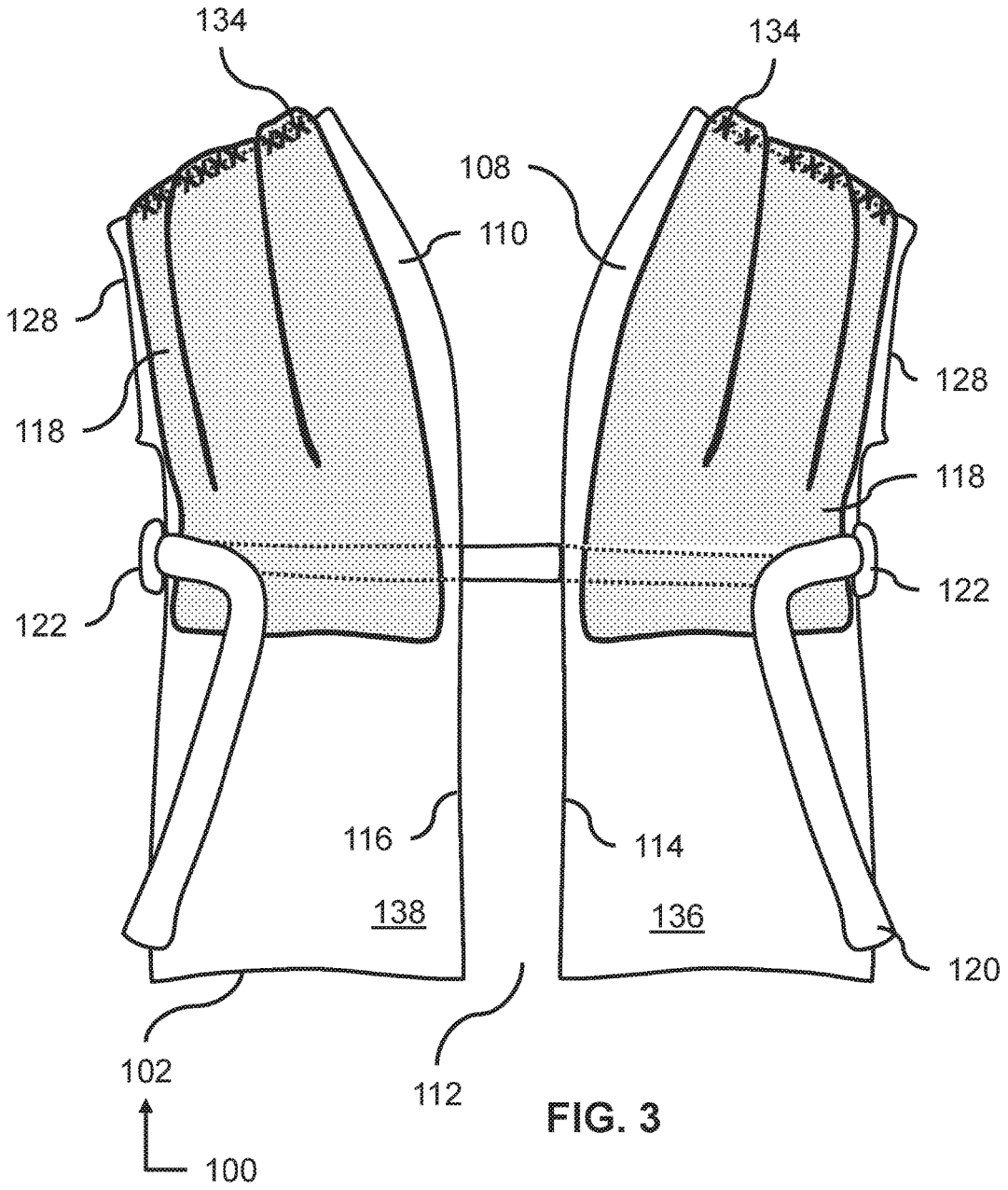
FIG. 3 depicts a detailed partial front view of an embodiment of the apparatus of FIG. 1.
Figure 4:
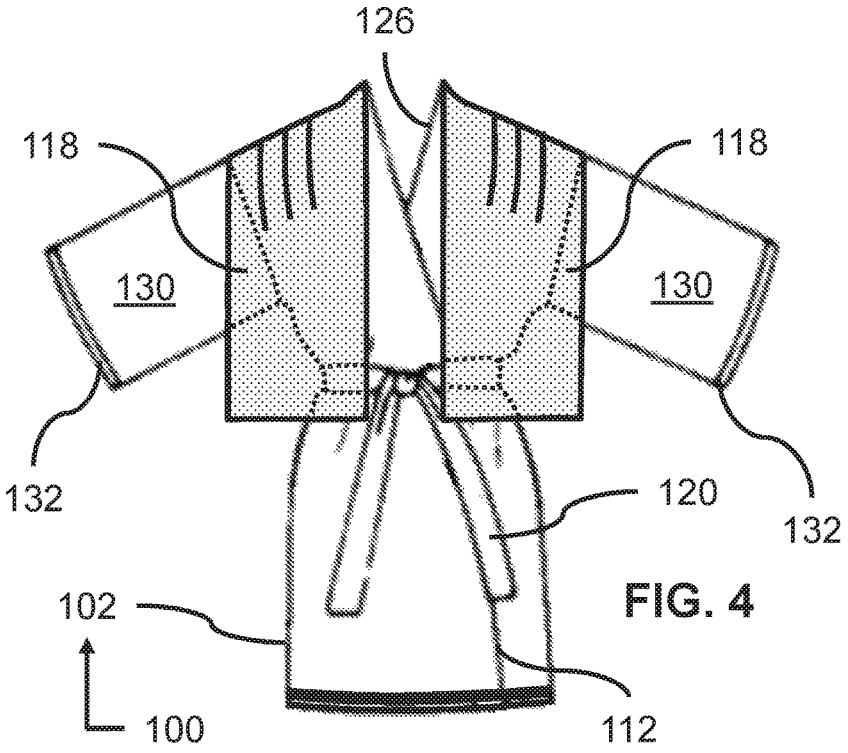
FIG. 4 and FIG. 5 depict front views of an embodiment of the apparatus of FIG. 1.
Figure 5:
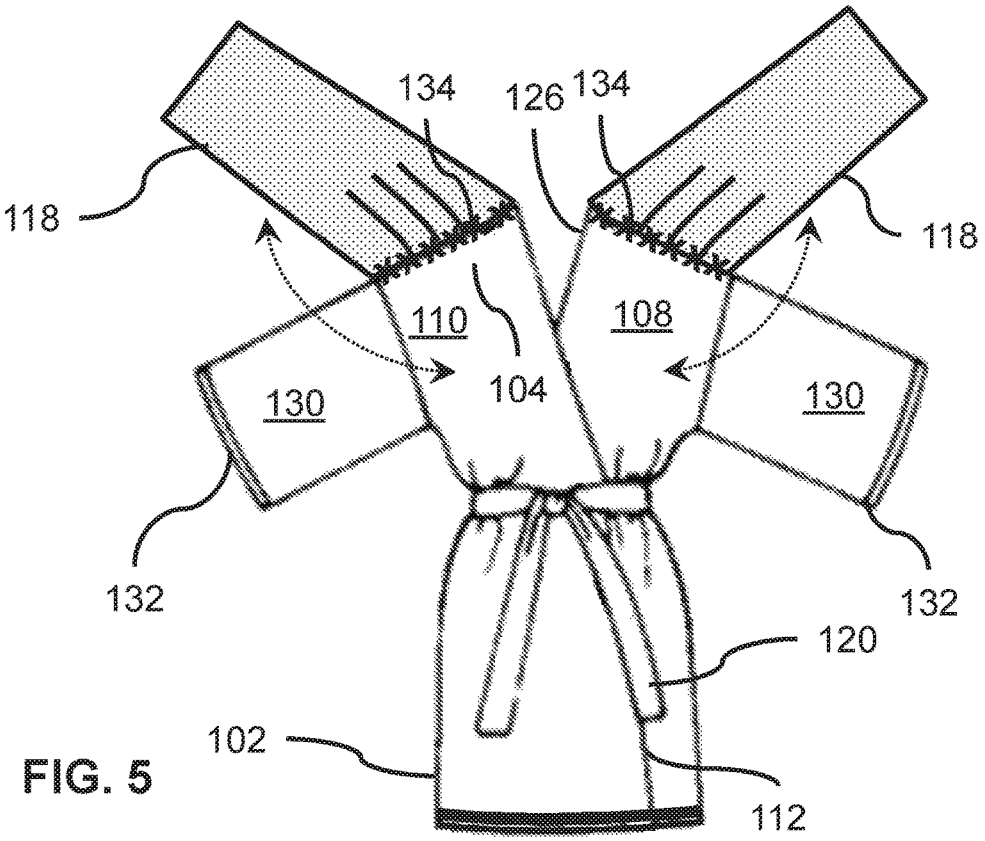

The bathrobe 102 is also called a dressing gown, a morning gown, a housecoat, or a robe. Preferably, the bathrobe 102 is made from towelling and/or other absorbent textile. More preferably, the bathrobe 102 is configured to be donned (worn) while the user's (wearer's) body is wet, thereby serving both as a towel and an informal garment. Preferably, the bathrobe 102, in use, forms a loose fitting, open-fronted garment that is closed with a belt 120 (fabric belt) threaded through loops 122 (as depicted in FIG. 3) attached to the waistline (waist area) of the bathrobe 102. The bathrobe 102 may include any suitable textile material (fabric), such as: (A) cotton (suited to use in hot climates because cotton tends to absorb perspiration), (B) silk (not particularly suited to wet environments and not usually used after bathing), (C) microfiber (improved breathability and water absorption), (D) wool (for colder climates), and/or (E) nylon (for easier cleaning). The bathrobe 102 may include any suitable type and/or shape of weave, such as: (A) flannel (made from loosely spun yarn, such as cotton or wool), (B) terry (a pile fabric woven of cotton, with uncut loops on both sides, in which longer and denser loops are more absorbent), (C) velour (a fabric with cut loops for an improved coziness and softness), (D) waffle (provides a distinctive grid-like appearance), and/or (E) pique (a type of waffle weave that may be applied to cotton, velour, silk, and other fabrics). The bathrobe 102 may include a collar 124 positioned around the neckline 126 (as depicted in FIG. 2, FIG. 4 and FIG. 5). It will be appreciated that the embodiment as depicted in FIG. 1 is such that the bathrobe 102 includes the collar 124. FIG. 2 and FIG. 3 depict the collar 124 removed (for an improved view of the bathrobe 102). The collar 124 has any suitable type and/or shape (or may include no collar, as depicted in FIG. 4 and FIG. 5), such as: (A) a shawl collar (this collar closes about the neck just like a shawl), (B) a kimono collar (a kimono style robe has no collar per se, and may provide more comfort to the wearer in warmer weather), and/or (C) a hooded collar (a hood is sewn into the neckline, which can be worn over the head to keep the head warm and help dry wet hair). Generally, the collar 124 is a part of the bathrobe 102 that encompasses the neckline of the bathrobe 102 so as to fold or roll over the neckline of the bathrobe 102.

Figure 7:
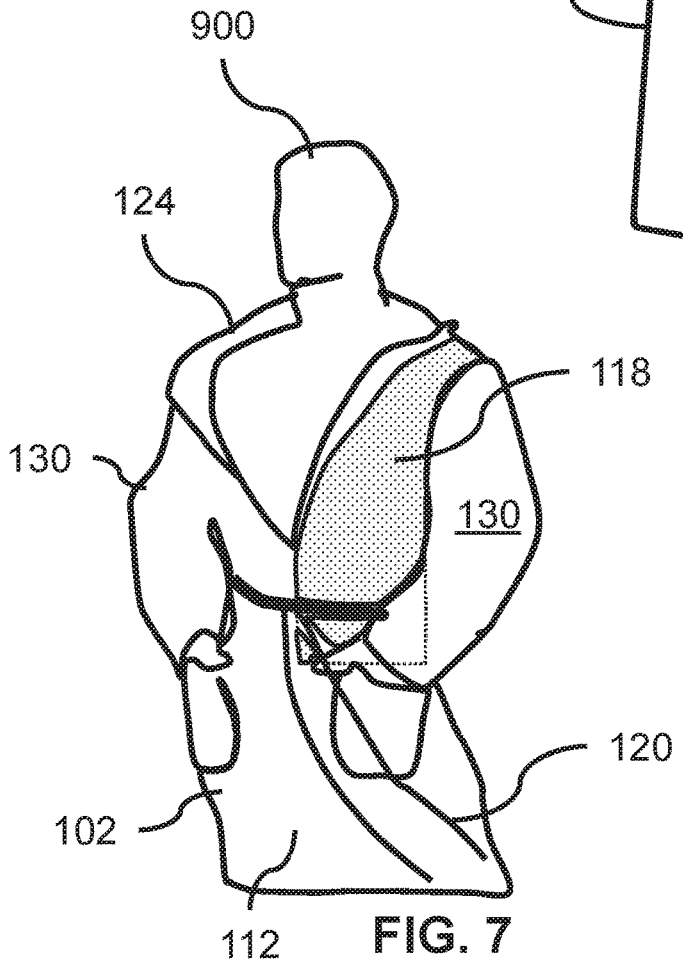
FIG. 7 depicts a perspective view of an embodiment of the apparatus of FIG. 1.

The yoke section 104 surrounds (at least in part) a neck opening 106 configured to receive the neck of a user 900 (for instance, as depicted in FIG. 7).

Preferably, the yoke section 104 includes a shaped pattern piece that forms part of the bathrobe 102, and is fitted around the neck and shoulders. The yoke section 104 is configured to provide support for looser parts of the bathrobe 102, such as a gathered skirt, etc. Preferably, the yoke section 104 includes a horizontally aligned piece of fabric positioned proximate to the shoulders (of the user). The yoke section 104 extends between each of the armholes 128 (defined by the bathrobe 102, and as depicted in FIG. 3) and the collar 124 (between a length extending from shoulder to shoulder). The armholes 128 are an opening in the bathrobe 102 in which respective instances of an arm 130 are sewn (attached) thereto. Preferably, a cuff 132 (a fold or band serving as a trimming or finish) is positioned at the bottom of the arm 130 (and is affixed thereto). Generally, the yoke section 104 includes a shaped piece of fabric fitted about or below the neck section and/or the shoulder section of the bathrobe 102, from which the remaining sections of the bathrobe 102 may hang therefrom. It will be appreciated that the yoke section 104 may be split in two, and is then called the split yoke.

The front left chest area 108 extends below the yoke section 104. The front left chest area 108 is configured to be positioned on the front left chest of the user 900 once the user 900 wears the bathrobe 102 (for instance, as depicted in FIG. 7).

The front right chest area 110 extends below the yoke section 104. The front right chest area 110 is spaced apart from the front left chest area 108. The front right chest area 110 is configured to be positioned on the front right chest of the user 900 once the user 900 wears the bathrobe 102 (for instance, as depicted in FIG. 7).

The vertically-extending placket 112 extends below the yoke section 104. The vertically-extending placket 112 may be called a parting line. The vertically-extending placket 112 physically separates the front left chest area 108 and the front right chest area 110. In addition, the vertically-extending placket 112 physically separates the front left skirt area 136 and the front right skirt area 138. The vertically-extending placket 112 has a left portion 114 (as depicted in FIG. 3) bordering the front left chest area 108 and also has a right portion 116 (as depicted in FIG. 3) bordering the front right chest area 110.

Preferably, the vertically-extending placket 112 defines an opening in the upper front part of the bathrobe 102. The vertically-extending placket 112 is configured to allow the bathrobe 102 to be put on or removed by the user. The vertically-extending placket 112 may include one or more layers of fabric (to give support and strength to the placket fabric because the vertically-extending placket 112 may be subjected to stress when the bathrobe 102 is worn). The two sides of the vertically-extending placket 112 may overlap.

The elongated towel assembly 118 is fixedly coupled to the bathrobe 102. The elongated towel assembly 118 is vertically aligned along a vertical length of the vertically-extending placket 112. The elongated towel assembly 118 extends (drapes), at least in part, along any one of (A) the front left chest area 108, (B) the front right chest area 110, and (C) the front left chest area 108 and the front right chest area 110. Preferably, two instances of the elongated towel assembly 118 extends (drapes), at least in part, along the front left chest area 108 and the front right chest area 110, respectively. The elongated towel assembly 118 vertically hangs along any one of (A) the left portion 114, (B) the right portion 116, and (C) the left portion 114 and the right portion 116 of the vertically-extending placket 112.

Preferably, the elongated towel assembly 118 is used for drying the hair and face (of the user) without the need for extra towels (towels that are separate from the bathrobe 102).

Preferably, the elongated towel assembly 118 includes a piece of absorbent fabric used for drying or wiping the head, the face and the hair (that is, the upper parts of) of the user. The elongated towel assembly 118 is configured to draw moisture through direct contact by using a blotting or a rubbing motion. The elongated towel assembly 118 may be made from cotton, rayon, bamboo, non-woven fibers, and other materials (and any equivalent thereof). In accordance with a preferred embodiment, the elongated towel assembly 118 includes a pleated towel (a towel having a pleat). The pleat includes a single fold, a double fold and/or multiple folds that are formed (to be formed) in the elongated towel assembly 118. The pleat is, preferably, held in position by stitching inserted along the elongated towel assembly 118. In accordance with a more preferred embodiment, the elongated towel assembly 118 includes pleated towels affixed (attached) along the shoulder seams located on both sides of the shoulder sections of the bathrobe 102, and the pleated towels extend vertically downward and are positioned on opposite sides of the vertically-extending placket 112. It will be appreciated that the pleats gives the towel more width (at one end of the towel), if desired. More preferably, the elongated towel assembly 118 is positioned, at least in part, under the collar 124.

In accordance with a preferred embodiment, the bathrobe 102 includes spaced apart instances of the elongated towel assembly 118 fixedly attached to the yoke section 104 (the shoulder sections) and extend down over the front chest portions of the bathrobe 102. Preferably, one instance of the elongated towel assembly 118 is attached onto the right shoulder portion of the bathrobe 102 and another instance of the elongated towel assembly 118 is attached onto the left shoulder portion of the bathrobe 102. Preferably, the elongated towel assembly 118 extends just below the belt 120 in such a way that (A) the length of the elongated towel assembly 118 is short enough so that they do not go below the waistline that is located on the front or the back of the body of the user, and/or (B) the length of the elongated towel assembly 118 is long enough so that it may be lifted up and used to dry the hair (the neck, the face or upper part of the body) with a free and wide range of circular or back-and-forth movements by the hand of the user.

Once the bathrobe 102 is worn by the user 900 (as depicted in FIG. 7), the user 900 may grasp (with the user's hand) and use the elongated towel assembly 118 for drying the head, the face, the neck, and/or the hair.

In addition, the bathrobe 102 may reduce the need for separate (detached) towels that match style of the bathrobe 102.

For instance, many hotel guests use more towels than they actually need, and sometimes the guests throw the towels on the floors, etc. By having the elongated towel assembly 118 attached to the bathrobe 102, fewer head-drying towels may be provided to the guests or may require cleaning (thereby lowering cleaning costs for the hotel). For instance, the hotel manager may provide a good presentation of the bathrobe 102 in a folded state along with a thank-you note to the guests for helping the environment by using the elongated towel assembly 118 attached to the bathrobe 102 (guests may be less inclined or motivated to simply toss the towel onto the floor after each use). The bathrobe 102 helps reduce the cleaning and disinfecting expenses of the hotel, not to mention less environmentally harmful waste (by using less detergents for cleaning towels and robes).

Hotel towels are generally washed excessively and even further disinfected, with special chemicals and sophisticated equipment. However, some hotel guests may still wonder and feel a little uncomfortable to use these towels for their faces and hair, because they might have been used in inappropriate ways by previous guests and/or by housekeeping. The elongated towel assembly 118 that is attached to the bathrobe 102 makes it relatively difficult to use the elongated towel assembly 118 for areas other than face and head (this may provide some hotel guests with peace of mind).

For the domestic case (use), especially in relatively larger families with limited bathroom space, less hooks may be needed. For example, a family of four may have their face towels, head towels, and bathrobes hung to four hooks, and no additional hooks may be needed. Even after washing hands, the family members may use the towels attached to their own instance of the bathrobe 102. If the family has a guest staying over, just one instance of the bathrobe 102 may be sufficient for the needs of the guest (for drying the body, the head, the hair, the face, and/or the hands (when needed as such). Perhaps what may be needed is then an additional robe-hanging hook for the guest.

FIG. 3 depicts a detailed partial front view of an embodiment of the apparatus 100 of FIG. 1.

In accordance with the embodiment as depicted in FIG. 3, the collar 124 (as depicted in FIG. 1) is not shown or installed to the bathrobe 102. In accordance with the embodiment as depicted in FIG. 3, the elongated towel assembly 118 is fixedly attached to the yoke section 104 by the stitches 134 (also depicted in FIG. 5). Generally, the instances of the elongated towel assembly 118 are affixed to the bathrobe 102 along the stitches 134. Preferably, the stitches 134 are spatially aligned along the top shoulder section of the bathrobe 102, extending on opposite sides of the yoke section 104 of the bathrobe 102.

Preferably, a length of the elongated towel assembly 118 extends just below the belt 120. The length of the elongated towel assembly 118 depends on the vertical length of the bathrobe 102.

FIG. 4 and FIG. 5 depict front views of an embodiment of the apparatus 100 of FIG. 1.

In accordance with the embodiments as depicted in FIG. 4 and FIG. 5, the bathrobe 102 includes no collar thereby revealing the neckline 126 of the bathrobe 102.

In accordance with the embodiment as depicted in FIG. 4, the instances of the elongated towel assembly 118 are positioned on (and drape or extend along) opposite frontal chest sections of the bathrobe 102 (in which this is called the normal or operative position of the elongated towel assembly 118).

In accordance with the embodiment as depicted in FIG. 5, the instances of the elongated towel assembly 118 are affixed to the bathrobe 102 along the stitches 134. Preferably, the stitches 134 are spatially aligned along the top shoulder section of the bathrobe 102, extending on opposite sides of the yoke section 104 of the bathrobe 102. The instances of the elongated towel assembly 118 are depicted as lifted away from the bathrobe 102 to better depict the view of the stitches 134.

Figure 6:
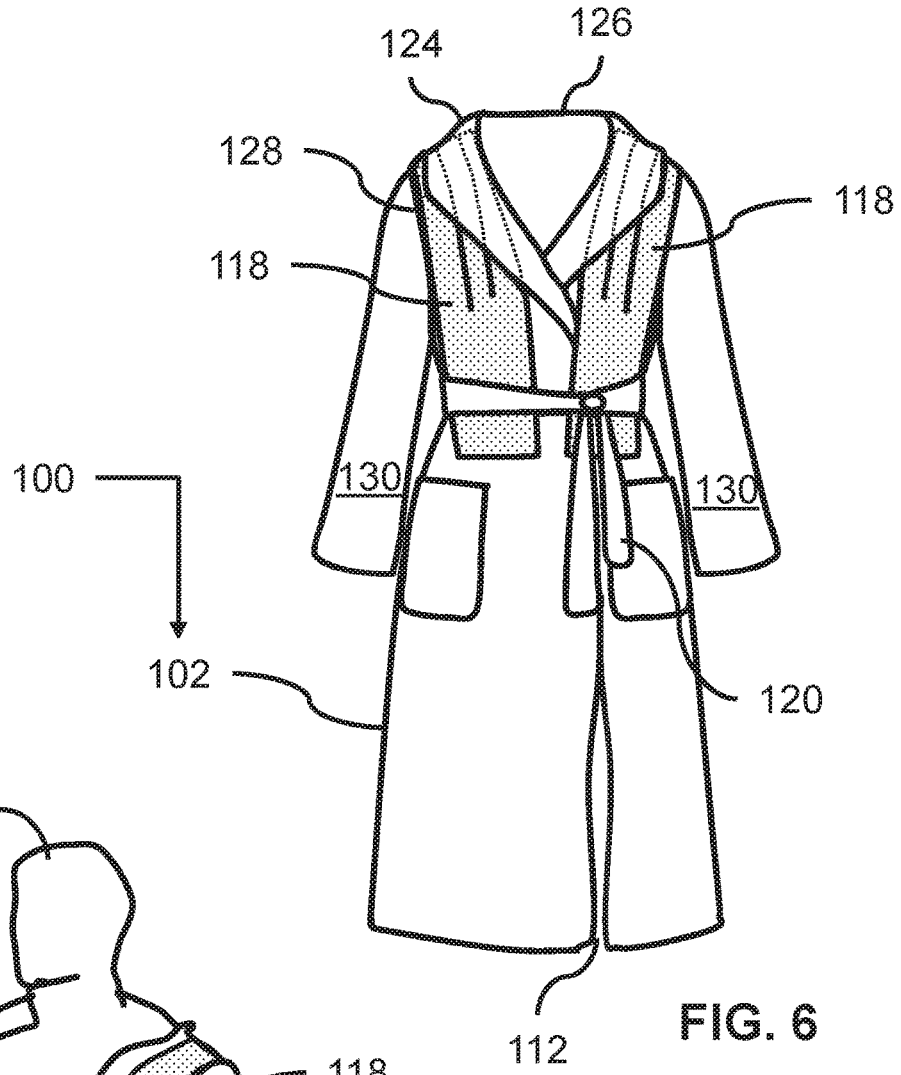
FIG. 6 depicts a front view of an embodiment of the apparatus of FIG. 1.

FIG. 6 depicts a front view of an embodiment of the apparatus 100 of FIG. 1.

In accordance with the embodiment as depicted in FIG. 6, the collar 124 is relatively wider (compared to other embodiments of the bathrobe 102 as depicted in other FIGS.), in which the collar 124 may cover up (at least in part) the elongated towel assembly 118 at the shoulder sections of the bathrobe 102 (from the neckline 126 to the armholes 128 that are positioned or formed on both sides of the bathrobe 102).

FIG. 7 depicts a perspective view of an embodiment of the apparatus 100 of FIG. 1.

In accordance with the embodiment as depicted in FIG. 7, there is a single instance of the elongated towel assembly 118 that is fixedly coupled to the bathrobe 102. The elongated towel assembly 118 vertically hangs from and extends along the left-side vertically extending front portion of the bathrobe 102. This is done in such a way that the vertically-extending placket 112 is available for usage by the user 900. It will be appreciated that in accordance with a preferred embodiment, two instances of the elongated towel assembly 118 are positioned on both sides of the frontal section of the bathrobe, and are both affixed to the respective sides of the shoulder section of the bathrobe 102.

It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus 100 (if so desired) to adjust to manufacturing requirements and still remain within the scope of the invention as described in at least one or more of the claims. This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly or component that may be superior to any of the equivalents available to the person skilled in the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. A towel-and-bathrobe assembly, comprising:

an elongated towel assembly; and a bathrobe having a front section including a right panel and a left panel; and the bathrobe also having a rear panel including a right lateral side fixedly attached to the right panel, and the rear panel also including a left lateral side fixedly attached to the left panel; and the rear panel, the right panel and the left panel configured to be donned by a wearer while the body of the wearer is wet and naked; and the right panel, the left panel and the rear panel extending downward from the shoulder section over the waist of the wearer once the bathrobe is donned by the wearer; and the front section including shoulder sections having shoulder seams configured to contact the shoulders of the wearer once the front section is donned by the wearer while the body of the wearer is wet and naked; and the front section having an inner surface being configured to contact the body of the wearer once the front section is donned by the wearer while the body of the wearer is wet and naked; and the front section having an outer surface being configured to face away from the body of the wearer once the front section is donned by the wearer while the body of the wearer is wet and naked, and once the inner surface of the front section of the bathrobe, in use, contacts the body of the wearer; and the front section having a left-sided vertically extending front portion; and the front section also having a right-sided vertically extending front portion being spaced apart from the left-sided vertically extending front portion; and a vertically-extending placket extending along the front section; and the vertically-extending placket being configured to allow the front section to be put on or removed by the wearer; and the elongated towel assembly being fixedly attached to the shoulder sections of the front section in such a way that the elongated towel assembly extends along the outer surface of the front section, once the front section is donned by the wearer while the body of the wearer is wet and naked, and once the inner surface of the front section of the bathrobe, in use, contacts the body of the wearer; and the elongated towel assembly being non-removable from the shoulder sections of the front section by the wearer; and the elongated towel assembly being configured to vertically hang and extend in such a way that the elongated towel assembly is available for usage by the wearer once the front section is donned by the wearer while the body of the wearer is wet and naked, and once the inner surface of the front section of the bathrobe, in use, contacts the body of the wearer; and the elongated towel assembly being configured to vertically hang from and extend along, once the elongated towel assembly is fixedly attached to the shoulder sections of the front section, at least one of:

the left-sided vertically extending front portion, the right-sided vertically extending front portion, and the left-sided vertically extending front portion and the right-sided vertically extending front portion; and the elongated towel assembly affixed to the shoulder section with stitches, and the stitches extending, at least in part, along the shoulder section, and in which the shoulder section extends between (A) a location where an arm of the bathrobe is attached to the shoulder section, and (B) a yoke section of the bathrobe that surrounds, at least in part, a neck opening configured to receive the neck of the wearer.

2. The towel-and-bathrobe assembly of claim 1, wherein:

the elongated towel assembly includes a towel having a pleat formed in the elongated towel assembly; and the towel is held in position by stitching inserted along, at least in part, the elongated towel assembly.

3. The towel-and-bathrobe assembly of claim 1, wherein:

the elongated towel assembly is positioned, at least in part, under a collar of the front section.

4. The towel-and-bathrobe assembly of claim 1, wherein:

a first instance of the elongated towel assembly is attached onto a right shoulder portion of the front section; and a second instance of the elongated towel assembly is attached onto a left shoulder portion of the front section.

5. The towel-and-bathrobe assembly of claim 1, wherein:

the elongated towel assembly is fixedly attached to the shoulder seams of the shoulder sections of the front section; and the elongated towel assembly, in use, also extends, at least in part, along the vertically-extending placket once the wearer, in use, stands up straight and once the front section is donned by the wearer while the body of the wearer is wet and naked, and once the inner surface of the front section of the bathrobe, in use, contacts the body of the wearer; and the elongated towel assembly, in use, is graspable and usable, by the wearer, for drying the hair, the neck and the face of the wearer with a free range of movements by the hand of the wearer once the front section is donned by the wearer while the body of the wearer is wet and naked, and once the inner surface of the front section of the bathrobe, in use, contacts the body of the wearer; and the front section is positioned between the elongated towel assembly and the wearer, and the elongated towel assembly, in use, is seen and is usable by the wearer once the front section is donned by the wearer while the body of the wearer is wet and naked, and once the inner surface of the front section of the bathrobe, in use, contacts the body of the wearer; and the bathrobe, in use, forms a loose fitting, open-fronted garment that is closed with a belt threaded through loops attached to a waist area of the bathrobe.

6. A towel-and-bathrobe assembly, comprising:

an elongated towel assembly; and a bathrobe having a front section including a right panel and a left panel; and the bathrobe also having a rear panel including a right lateral side fixedly attached to the right panel, and the rear panel also including a left lateral side fixedly attached to the left panel; and the rear panel, the right panel and the left panel configured to be donned by a wearer while the body of the wearer is wet and naked; and the right panel, the left panel and the rear panel extending downward from the shoulder section over the waist of the wearer once the bathrobe is donned by the wearer; and the front section including shoulder sections having shoulder seams configured to contact the shoulders of the wearer once the front section is donned by the wearer while the body of the wearer is wet and naked; and the front section having an inner surface being configured to contact the body of the wearer once the front section is donned by the wearer while the body of the wearer is wet and naked; and the front section having an outer surface being configured to face away from the wearer once the front section is donned by the wearer while the body of the wearer is wet and naked, and once the inner surface of the front section of the bathrobe, in use, contacts the body of the wearer; and the front section including:

a yoke section surrounding, at least in part, a neck opening configured to receive the neck of the wearer; and a front left chest area extending below the yoke section; and the front left chest area being configured to be positioned on a front left chest of the wearer once the wearer wears the front section; and a front right chest area extending below the yoke section; and the front right chest area being spaced apart from the front left chest area; and the front right chest area being configured to be positioned on a front right chest of the wearer once the wearer wears the front section; and a front left skirt area positioned below the front left chest area; and a front right skirt area positioned below the front right chest area; and a vertically-extending placket extending below the yoke section; and the vertically-extending placket physically separating the front left chest area from the front right chest area; and the vertically-extending placket having a left portion bordering the front left chest area; and the vertically-extending placket having a right portion bordering the front right chest area; and the left portion bordering the front left skirt area; and the right portion bordering the front right skirt area; and the elongated towel assembly being fixedly coupled to the front section; and the elongated towel assembly being vertically aligned along a vertical length of the vertically-extending placket; and the elongated towel assembly extending, at least in part, along any one of the front left chest area, the front right chest area, and the front left chest area and the front right chest area; and the elongated towel assembly being fixedly attached to the front section in such a way that once the wearer, in use, stands up straight and wears the front section, the elongated towel assembly, in use, extends downwardly; and the elongated towel assembly extending, at least in part, along the vertically-extending placket; and the elongated towel assembly being graspable and usable, by the wearer, for drying the hair, the neck and the face of the wearer with a range of movements by the hand of the wearer; and the elongated towel assembly being fixedly attached to the outer surface of the front section in such a way that the elongated towel assembly, in use, hangs along the outer surface of the front section once the front section, in use, is donned by the wearer; and the front section being positioned between the elongated towel assembly and the wearer in such a way that the elongated towel assembly, in use, is seen and usable by the wearer once the front section is donned by the wearer; and the elongated towel assembly being fixedly attached to the front section by stitches, in which the stitches are spatially aligned and extend along a length of a shoulder section of the front section, and in which the stitches, in use, prevent selective removal of the elongated towel assembly from the front section by the wearer; and the front section forming a loose fitting, open-fronted garment being closable with a belt threaded through loops attached to a waist area of the front section; and the elongated towel assembly affixed to the shoulder section with stitches, and the stitches extending, at least in part, along the shoulder section, and in which the shoulder section extends between (A) a location where an arm of the bathrobe is attached to the shoulder section, and (B) the yoke section of the bathrobe that surrounds, at least in part, the neck opening configured to receive the neck of the wearer.

7. The towel-and-bathrobe assembly of claim 6, wherein:

the front section includes a collar positioned around a neckline of the front section.

8. The towel-and-bathrobe assembly of claim 6, wherein:

the yoke section includes a shaped pattern piece that forms part of the front section, and is fitted around the neck and shoulders; and the yoke section is configured to provide support for looser parts of the front section; and the yoke section is vertically below the shoulder section of the front section; and the yoke section extends from shoulder to shoulder of the front section.

9. The towel-and-bathrobe assembly of claim 6, wherein:

the vertically-extending placket defines an opening in an upper front part of the front section; and the vertically-extending placket is configured to allow the front section to be put on or removed by the wearer.

10. The towel-and-bathrobe assembly of claim 6, wherein:

the elongated towel assembly includes a towel having a pleat formed in the elongated towel assembly; and the towel is held in position by stitching inserted along, at least in part, the elongated towel assembly.

11. The towel-and-bathrobe assembly of claim 6, wherein:

the elongated towel assembly includes towels.

12. The towel-and-bathrobe assembly of claim 6, wherein:

the elongated towel assembly includes towels, in which the towels are affixed along the shoulder seams of the shoulder sections of the front section; and the towels extend vertically downward and are positioned on opposite sides of the vertically-extending placket.

13. The towel-and-bathrobe assembly of claim 6, wherein:

the elongated towel assembly is positioned, at least in part, under a collar of the front section.

14. The towel-and-bathrobe assembly of claim 6, wherein:

the front section includes spaced apart elongated towel assemblies being fixedly attached to the yoke section and extending down over, at least in part, and along, at least in part, the front left chest area and the front right chest area.

15. The towel-and-bathrobe assembly of claim 14, wherein:

a first instance of the elongated towel assembly is attached onto a right shoulder portion of the front section; and a second instance of the elongated towel assembly is attached onto a left shoulder portion of the front section.

16. The towel-and-bathrobe assembly of claim 6, wherein:

the elongated towel assembly extends below the belt of the front section in such a way that the elongated towel assembly is long enough to be lifted up and used to dry the hair of the wearer with the range of movements of the hand of the wearer.

17. The towel-and-bathrobe assembly of claim 6, wherein:

a length of the elongated towel assembly extends below the belt of the front section.

18. The towel-and-bathrobe assembly of claim 6, wherein:

the elongated towel assembly includes:

a first elongated towel assembly, in which the first elongated towel assembly is positioned on, and drapes along, a first frontal chest section of the front section; and a second elongated towel assembly, in which the second elongated towel assembly is positioned on, and drapes along, a second frontal chest section of the front section.

19. The towel-and-bathrobe assembly of claim 6, wherein:

the front section includes a collar, and the collar is configured to cover up, at least in part, the elongated towel assembly at the shoulder sections of the front section from a neckline to armholes positioned on both sides of the front section.

20. The towel-and-bathrobe assembly of claim 6, wherein:

the elongated towel assembly is fixedly coupled to the front section; and the elongated towel assembly, in use, vertically hangs from and extends along a vertically extending portion of the front section in such a way that the vertically-extending placket is available for usage by the user.

* * * * *